United States Patent [19]

Bauer et al.

[11] 3,950,831

[45] Apr. 20, 1976

[54] APPARATUS FOR THE MANUFACTURE OF CRIMPED FILAMENTS

[75] Inventors: Wolfgang Bauer, Heidelberg; Dieter Herion, Frankenthal; Wolfgang Martin, Ludwigshafen; Klaus Metzger, Mutterstadt, all of Germany

[73] Assignee: BASF Farben and Fasern AG, Ludwigshafen (Rhine), Germany

[22] Filed: July 1, 1974

[21] Appl. No.: 484,436

[30] Foreign Application Priority Data

July 6, 1973 Germany ..... 2334381

[52] U.S. Cl. ..... 28/1.4

[51] Int. Cl.[2] ..... D02G 1/16

[58] Field of Search ..... 28/1.4, 72.12; 57/34 HS, 157 F; 226/7, 97; 302/25, 63

[56] References Cited

UNITED STATES PATENTS

| | | | |
|---|---|---|---|
| 3,237,269 | 3/1966 | Hawkins | 28/1.4 |
| 3,261,071 | 7/1966 | Clendening et al. | 28/1.4 |
| 3,353,344 | 11/1967 | Clendening | 28/1.4 X |
| 3,555,808 | 1/1971 | Gutmann | 28/72.12 X |
| 3,591,955 | 7/1971 | Fujita et al. | 28/72.12 X |
| 3,727,274 | 4/1973 | White | 28/1.4 |

*Primary Examiner*—Louis K. Rimrodt

*Attorney, Agent, or Firm*—Johnston, Keil, Thompson & Shurtleff

[57] ABSTRACT

Apparatus for crimping filaments using turbulent heated fluids to which the filaments are exposed in two treatment chambers connected to one another. The first treatment chamber is constructed in two parts, the parting plane between the two parts is stepped and the filament guide means are intersected by the parting plane. The filaments are easy to introduce and the operating temperature need not be reduced in the event of any filament breaking.

3 Claims, 4 Drawing Figures

APPARATUS FOR THE MANUFACTURE OF CRIMPED FILAMENTS

The invention relates to an apparatus for crimping filaments of synthetic, linear, high molecular weight materials by means of heated fluids, preferably gases, the apparatus consisting of two snugly fitting and frictionally connected treatment chambers, the first treatment chamber possessing, on its end face, a filament inlet channel, a cylindrical cavity located coaxially to the filament inlet channel, with means for the introduction of the fluid, and a filament guide channel which is enlarged in a cascade-like manner in the lower zone so as to receive the second treatment chamber.

It is known to impart a crimp to synthetic spun filaments in closed tubular treatment chambers by means of a fluid medium, especially a gas. Thus, for example, German Laid-Open Specification No. 1,435,366 describes an apparatus which consists of means for introducing filamentous material into a feed line for the pressure medium, and a chamber adjoining thereto, of which the average diameter is greater than that of the feed line. The filaments are taken up by the stream of gas, conveyed into the pressure chamber via a pipe divider, and are crimped.

German Laid-Open Specification No. 2,006,022 furthermore discloses an apparatus for the manufacture of texturized filaments of synthetic, linear, high molecular weight materials by means of heated fluids in which a closed, first treatment chamber is provided with a union for the introduction of the fluid, a filament inlet channel on one end face of the first treatment chamber and a filament guide channel which projects from the other end face into the first treatment chamber. This filament guide channel, which is rigidly connected to the treatment chamber, is fixed to a second treatment chamber attached to its free end, the second chamber being channel-shaped and provided with slits.

However, these apparatuses are not entirely satisfactory since they are cumbersome to operate, especially when starting up, and are not reliable in operation. The difficulties arise mainly in introducing the filaments into the apparatuses since these designs are not self-priming or at least not adequately so. If operating temperatures in the melting range of the filamentous material employed are required, this disadvantage is even more serious because in that case the filaments can only be introduced into the apparatuses at substantially lower temperatures and this requires considerable time and leads to substantial waste of material.

The disadvantages mentioned above have now been circumvented by the invention of an apparatus of the type initially described, for the manufacture of crimped filaments, which according to the invention is characterized in that the first treatment chamber is constructed in two parts, the parting plane between the two parts is stepped and the filament inlet channel, the cylindrical cavity and the filament guide channel are intersected by the parting plane. These features ensure easy handling of the filaments when they are being introduced into the apparatus, even if high speeds are used. Furthermore it is not necessary to reduce the operating temperature if the filament breaks. Further advantages are the simple contruction, which presents no problems, and the fact that the filament guide devices are not prone to soiling. Finally, a substantial reduction in material waste is achieved.

In an advantageous embodiment of the apparatus, the filament inlet channel, the cylindrical cavity and the filament guide channel lie in the right angle between a main surface and a subsidiary surface of the parting plane. This avoids losses in pressure of the fluid, since the surfaces which include the right angle make it possible to achieve an adequate seal if they are appropriately designed and machined.

According to a further characteristic of the invention, the two parts of the first treatment chamber are guided to enable them to move perpendicularly to the main surfaces of the parting plane. This proves advantageous particularly if the crimping of the filaments requires very high operating temperatures.

In the apparatus according to the invention, the ratio of the cross-section of the filament inlet channel to the cross-section of the filament guide channel is a decisive factor. If the cross-sections are circular, as is usually the case, the ratio of the diameters is 1.1 to 4, particularly 1.6 to 2.2. The absolute diameters depend on the filamentous material which is to be crimped. For example, for deniers of about 1,300 dtex, 1 mm is a suitable diameter for the filament inlet channel. Between the filament inlet channel and the filament guide channel, which are mounted at a distance from one another, a cylindrical cavity is provided, of which the dimensions $d \times h$ (diameter $\times$ height) are about $15 \times 0.1$ to $18 \times 3$ mm. A jet through which the gaseous fluid is introduced is inserted into the cylindrical surface of the cavity, appropriately at an angle of 30° to 60°. The fluid, preferably air, is introduced into the cavity through the jet via a metering device, a heating device and a channel into which a diaphragm may be inserted. The gas throughput is generally 1 to 10 $m^3$ (S.T.P.)/hour, whilst the gas temperature is about 100° to 400°C. Under the action of the heated fluid, which is in turbulent flow, the filaments are heated, in the first treatment chamber, to a temperature at which reorientation and recrystallization processes take place, and are transported, by means of frictional forces, through the filament guide channel into and through a second treatment chamber. In this second treatment chamber, which is in the form of a slit nozzle, the actual texturizing of the filaments occurs through an interchange between the fluid and the surrounding air and through the turbulence thereby produced. The second treatment chamber is inserted into a cascade-shaped, widened portion of the filament guide channel and is frictionally connected thereto, and to the first treatment chamber, to form a closed unit. According to the invention, the first treatment chamber consists of two parts which match one another. The parting plane between these parts is stepped (offset) and is formed by at least two main surfaces and a subsidiary surface. In general, one main surface and one subsidiary surface of each part is so designed and machined as to make it possible to provide a seal for the filament guide means. However it is also possible to fit the two parts to one another on the tongue and groove principle.

The parting plane can be caused to run in such a way that the filament inlet channel, the cylindrical cavity and the filament guide channel are intersected centrally by eccentrically, for example at a distance of 10 to 80% of the radius of the filament inlet channel, by the longitudinal axis. It is particularly advantageous if the filament guide means are located in the right angle between one main surface and one subsidiary surface. In that case, the filaments, on entering the apparatus, run up against the subsidiary surface of the parting plane and are then introduced into the filament guide devices. However, the main surface and the subsidiary surface can also be located at an angle to one another which is greater than or less than 90°.

An example of an embodiment of the apparatus according to the invention is shown diagrammatically in the drawings — FIGS. 1 to 4 — and is explained in more detail below.

Figure 1:
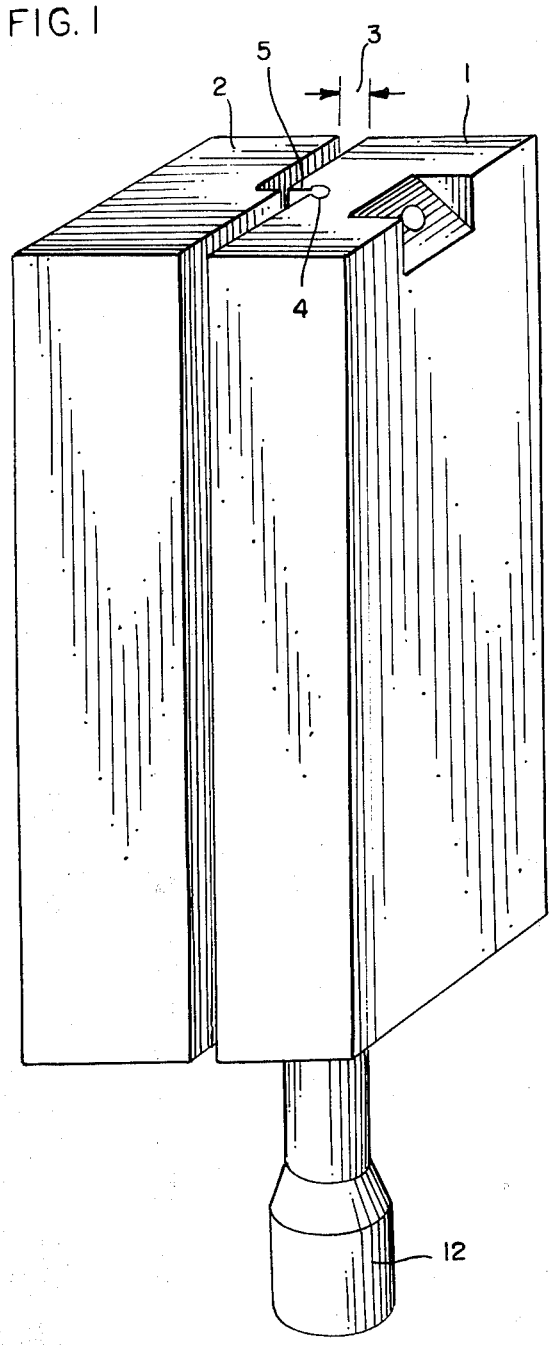
FIG. 1 shows a perspective view of the apparatus.
Figure 2:
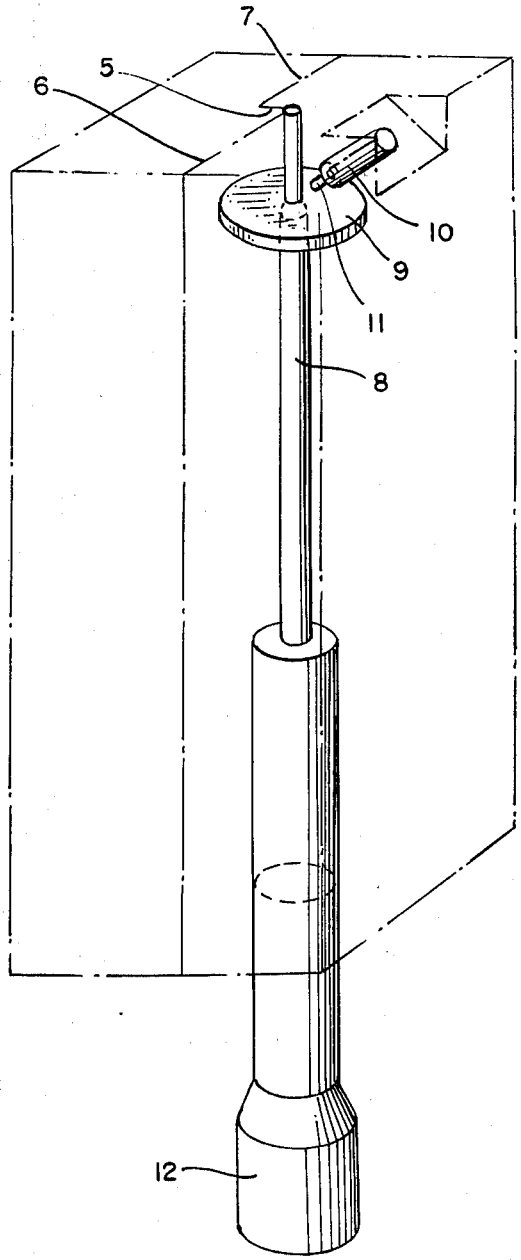
FIG. 2 shows the arrangement of the essential components.

As shown in FIG. 1, the two parts 1 and 2 of the first treatment chamber are located at a distance from one another. The magnitude of this distance 3 or gap corresponds to the width of the subsidiary surface 5. The filament inlet channel, which ends in the cylindrical cavity 9, is marked 4. The fluid is also introduced into this cavity 9 through a channel 10 and a nozzle 11. The filament guide channel 8 is provided as an extension of the filament inlet channel 4 and this matches the second treatment chamber 12. The parting plane of the first treatment chamber consists of two main surfaces 6 and 7 and a subsidiary surface 5.

Figure 3:
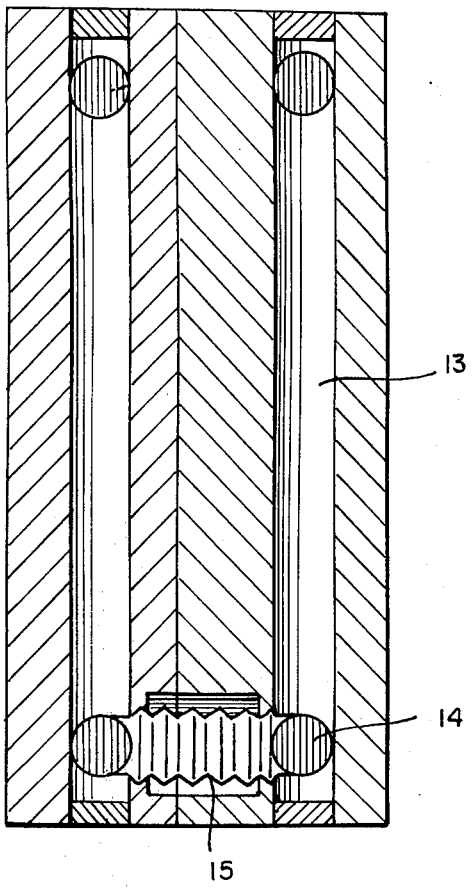
FIG. 3 shows a longitudinal section.
Figure 4:
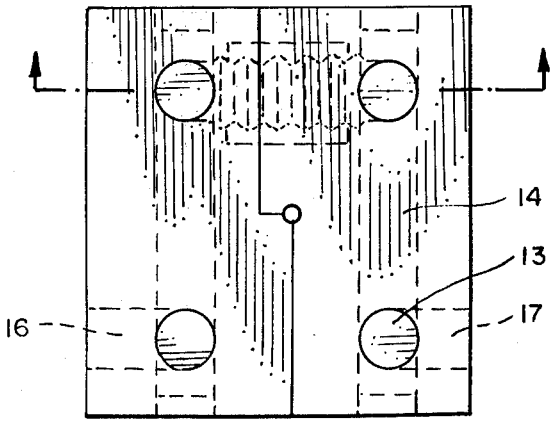
FIG. 4 shows a plan view, including the heating means.

The apparatus of the invention is heated to accord with its intended use. This heating can be effected either by means of electric heating cartridges which are kept at the intended temperature through a control means, or by means of a heat transfer agent, for example oil or Diphyl. A heating means is shown in FIGS. 3 and 4 and consists essentially of four channels 13 provided at the corners of the first treatment chamber and connected to one another through bores 14 and an elastic metal tube 15. In addition, an inlet orifice 16 and an outlet orifice 17 are provided at the sides.

We claim:

1. An apparatus for the manufacture of crimped filaments by means of heated fluids, said apparatus comprising:

a first and a second component in releasable contact with one another having defined therebetween a process channel in which said filaments travel and into which said fluid is passed;

the parting face between said first and second component having two surfaces parallel to the axis of said process channel and which intersect said process channel at an angle;

said parting face between said first and second component being mated so as to provide a substantial seal about said process channel.

2. The apparatus of claim 1 wherein said parting face further comprises:

two main surfaces offset from one another and a subsidiary surface connecting said main surfaces, the plane of one of said main surfaces and the plance of said subsidiary surface intersecting said process channel.

3. The apparatus of claim 2 wherein the angle of intersection of said main surface with said subsidiary surface at said process channel is substantially a right angle.

* * * * *